United States Patent [19]

Pejchal et al.

[11] 4,276,912

[45] Jul. 7, 1981

[54] WEFT THREAD CONTROL DEVICE FOR A WEAVING LOOM WITH REMOVAL OF THE WEFT THREAD FROM A SUPPLY SPOOL BESIDE THE LOOM

[75] Inventors: Karel Pejchal; Hans G. Fritzon, both of Ulricehamn; Raimo Lindström, Västra Frölunda, all of Sweden

[73] Assignee: Aktiebolaget IRO, Ulricehamn, Sweden

[21] Appl. No.: 68,547

[22] Filed: Aug. 22, 1979

[30] Foreign Application Priority Data

Aug. 22, 1978 [DE] Fed. Rep. of Germany ..... 2836715
Mar. 30, 1979 [DE] Fed. Rep. of Germany ..... 2912728

[51] Int. Cl.[3] ..... D03D 47/24
[52] U.S. Cl. ..... 139/437
[58] Field of Search ..... 139/196.2, 437, 438, 139/439

[56] References Cited

U.S. PATENT DOCUMENTS

| | | | |
|---|---|---|---|
| 3,417,793 | 12/1968 | Freihofer | 139/437 |
| 3,494,384 | 2/1970 | Amengual et al. | 139/437 |
| 3,554,240 | 1/1971 | Sakamoto | 139/437 |
| 4,147,187 | 4/1979 | Carlsson et al. | 139/437 |

*Primary Examiner*—Henry Jaudon
*Attorney, Agent, or Firm*—James E. Nilles

[57] ABSTRACT

In a loom having a weft thread supply spool at each side thereof and a shuttle whereby thread from each spool is alternately carried across the shed as a U-shaped loop, improved thread guide elements, one on each end of the batten, are actuated in consequence of movement of the batten through each of its reversal positions, at one of which the batten engages the last-laid weft thread to beat up the same and at the other of which the batten begins its return for another beating-up while the shuttle moves through the shed. Each thread guide element comprises a member mounted on the batten for bodily movement therewith and for rocking movement relative thereto. Each such member rocks between a first position wherein a thread eye thereon is located to dispose weft thread extending from its adjacent spool across the shuttle path and a second position wherein the thread eye holds the thread clear of that path. Each member is rocked to its first position upon movement of the batten through its said one reversal position and to its second position upon movement of the batten through its said other reversal position. Rocking is imparted either by the inertia of a weight on the member, due to acceleration and deceleration of the batten incident to reversal of its motion, or by a friction or magnetic retarding device connected between the member and the loom frame.

11 Claims, 12 Drawing Figures

Figure 1:
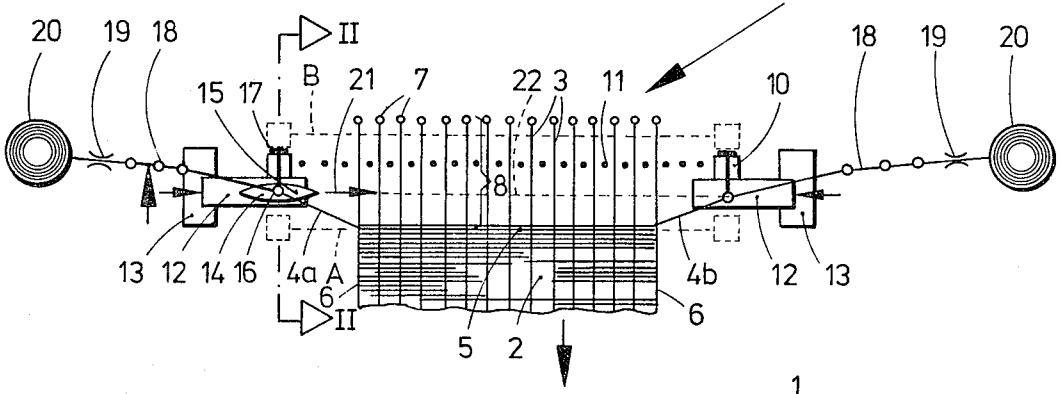

I
II

V
35
40
28
34
36
37
43
42
41
38
30
40
45
53
16
17
29
V
15
31
4a
39
14
33
32
10
12

WEFT THREAD CONTROL DEVICE FOR A WEAVING LOOM WITH REMOVAL OF THE WEFT THREAD FROM A SUPPLY SPOOL BESIDE THE LOOM

The invention relates to a weft thread control device for a weaving machine wherein the weft thread is removed from a supply spool and by means of a movable thread guide is presented to an insertion element having a thread engaging element, is engaged by this said insertion element and is inserted into the shed.

From U.S. Pat. No. 3,494,384 a weft thread control device is known for a shuttle loom in which the batten beats up the weft threads inserted into the shed alternately at the cloth fell. The weft threads are exposed to the shuttle and transported in the form of a U-shaped loop approximately as far as the centre of the shed. In order to guide and insert the weft threads a movable weft thread guide element in the form of a thread eyelet is provided at each fabric selvedge and these guide elements guide the weft threads alternately into the path of the shuttle. Thread tensioners and thread braking devices are arranged between the thread eyelets and the supply spools and so cooperate, in rhythm with cutting devices for the weft threads, that the supply of weft thread to the shuttle is stopped when the shuttle has reached the centre of the shed and stretches the weft thread, which has been cut off, through the shed. The shuttle travels through the shed during the time when the batten moves up to the rear dead centre and reverses and then moves back towards the fell of the coth. In this phase of movement almost the complete height of the shed is available to the shuttle so that there is no danger that it will be hindered in its path by the warp threads. Control of the thread eyelets takes place with the aid of electromagnets which are energized by means of an electronic control circuit operating in time with the weaving cycle and which move the thread eyes into the path of the shuttle when it passes into the shed, while the electromagnets move the respective thread eye out of the path of the shuttle when it passes out of the shed. The electronic control and control of movement of the thread eyes per se is expensive, complicated and relatively susceptible to faults since several intersecting movements have to be carried out.

The object underlying the invention is to improve a weft thread control device of the type stated at the outset, to the effect that it may ensure presentation and removal of the weft thread in reliable manner without any complicated control devices which are dependent on the mechanism of the loom and to the effect that the rocker movement takes place precisely and independently of additional forces.

The object is attained in accordance with the invention by the fact that the weft thread guide element is arranged on a rocker fixed pivotally on at least one side of the batten. The rocker in accordance with the invention is actuated by forces derived from the reversal of movement of the batten at each end its range of motion, whereby the rocker at one such reversal may be brought into a first position in which the weft thread guide element presents the weft thread to the thread engaging element, and at the other such reversal is brought into a second position in which the weft thread guide element keeps the weft thread out of the path of the thread engaging member.

Thus control devices which move the weft thread guide elements in time with the weaving machine are eliminated. The rocker utilizes the forces which must arise in the course of movement of the batten, for the purpose of controlling the movement of the weft thread guide elements. The solution which has been found is simple technically, reasonable in price and operates exceptionally reliably. It does not require very much space in the operating region of the weaving machine which is restricted in any case, and it can be matched by simple means to the respective requirements of weaving. It is of particular advantage that the device in accordance with the invention operates almost completely independently of the speed of the weaving rhythm and may be subsequently arranged on a loom which has already been in operation.

A preferred embodiment is characterized by the fact that the rocker can be brought into positions I and II by the inertial forces occurring in the rocker during the reversal of movement of the batten. Here the necessarily arising inertial forces are used to control the rocker on reversal of movement of the batten. These forces arise independently of the weaving rhythm exactly at the correct point in time in each case. Errors of pick-up are thus eliminated.

A preferred embodiment of a weft thread control device in accordance with the invention is further characterized by the fact that the rocker is connected to a frictional braking device arranged stationarily at a distance from the rocker and can be brought away from the frictional braking device into the first or second position, in which it remains supported and retained until renewed reversal of the movement of the batten. Only simple control devices are necessary for moving the rocker or lowering and raising the weft thread guide elements in rhythm. These control devices, which are constructed as frictional braking devices, necesssarily produce the impulses for movement of the weft thread guide elements through the reversals of direction occurring in the course of movement of the batten which are necessary for its functioning. The solution which has been found is technically simple and reasonable in price and operates exceptionally reliably and is unaffected by superimposed extraneous forces. The frictional braking devices do not require much space in the area of operation of the loom, which is restricted in any case and are easily matched to the respective requirements of weaving. It is particularly advisable for the frictional braking devices to operate almost completely independently of the speed of the weaving rhythm and also to be able to be arranged subsequently on a weaving machine which has already been in operation. Irregular speeds in the movement of the batten cannot affect the action of the frictional braking devices. In addition the rocker may be light and stream-lined and thus the mass moved by the batten remains small.

A further preferred embodiment in a weaving machine having weft thread insertion on both sides is characterized by the fact that a rocker is arranged on each side of the batten and that the rockers are synchronously pivotable. The synchronous movement of the two rockers is produced without any control means in this case, too, solely by means of the batten movement. It is clear that in this case one of the two rockers respectively performs a nonoperative stroke which is unimportant to the functioning of the control device however.

A further preferred embodiment provides for frictional braking devices to be fixed to the frame of the weaving machine on both sides of the batten, one for each rocker. The two frictional braking devices associated with the two rockers ensure synchronous movement of the two rockers.

A further embodiment of a weft thread control device in accordance with the invention is for a loom in which the insertion element, which is inserted into the shed before the reversal of the batten for return movement leaves the shed before impact of the batten, and is characterized in that, as the insertion element is inserted and the weft thread is picked up, the rockers are in the first position as a result of the reversal of movement of the batten during the preceding impact process and these rockers are pivoted into the second position by reversal of movement of the batten as the insertion element passes out of the shed. As a result of this measure the insertion element has a sufficiently long time for passing through the shed even in the case of a wide web of cloth. The weft thread guide elements are compelled at entry to hold the weft thread ready to be engaged by means of the pivot movements of the rockers, while the weft thread guide element pull the weft thread away as the shuttle passes out of the shed. The greatest deceleration or acceleration forces arise in the batten on impact and on the rearward reversal of movement, and these forces ensure exact pivoting of the rockers. The movement of the batten runs between the two movement reversal points in a largely harmonic manner so that there is no danger that the rockers could unintentionally leave a position once taken up.

In a further preferred embodiment of the weft thread control device in accordance with the invention it is advisable for the rocker to have at least one ballast weight arranged eccentrically with respect to its pivot axis and preferably adjustable or variable. Simple and rapid matching of the movement of the rocker to the weaving rhythm or weaving speed may be effected with the aid of the ballast weight which is either adjustable with respect to the pivot axis by means of its lever arm or variable in mass.

It is particularly preferred if an impact device defining the two positions is associated with the rocker. The impact device ensures that the weft thread guide element takes up the same position during each stroke.

A preferred embodiment of the weft thread control device in accordance with the invention may be achieved moreover if the rocker comprises a first arm which supports the ballast weight and which can be pivoted about the pivot axis, and if a second arm, projecting approximately perpendicular thereto and possibly having a further ballast weight and carrying the thread guide element, is fixed on to the first arm so as to be adjustable longitudinally of the said first arm.

This economical and simply effective solution is particularly robust and does not require very much space.

Furthermore it is advisable if provision is made for the second arm to be curved approximately in L-shape. The second arm then intervenes into the path of the insertion element from above and produces an exact geometry of the weft thread at the moment at which the thread engaging member of the insertion element engages the weft thread.

Furthermore it is favourable if a thread guide is arranged at the free end of the second arm of the weft thread guide element. A thread eyelet serves as a particularly reliable weft thread guide element.

In a further preferred embodiment of a weft thread control device in accordance with the invention, the stop device comprises a C-shaped block fixed to the batten, the mouth of which is penetrated by the arm of the rocker, and this arm has stop surfaces for restricting the movement of the arm and for defining the two positions. This stop arrangement not only secures the exact position of the thread guide element in the two positions but may also contribute to perfect guidance of the rocker during its pivot movements.

Since the rocker must be prevented from automatically pivoting out of its correct position as the result of vibrations or non-uniform movement of the batten, it is advisable if provision is made for the mouth of the block to be equipped with a convex arresting curve for the arm between the two stop surfaces. In order to overcome the arresting curve the rocker must have a definite force momentum which can only be produced at the points of the batten movement which are designed for this.

An additional or alternative locking of the rocker in the two positions may be achieved if a solution is selected in which the arm of the rocker is constructed metallically, at least in its portion penetrating the mouth, and permanent magnets are provided in the stop surfaces. The magnets keep the rocker in its desired position until there is an appropriately large acceleration or deceleration force in a condition to pivot the rocker against the other magnet.

A solution which is particularly satisfactory in practice is provided if the pivot axis of each rocker is arranged on the side of the batten remote from the path of the insertion element so that the second arm extends beyond the batten beam and towards the path of the insertion element and is curved downwardly at its end supporting the thread loop; and that the block is fixed to the top of the batten beam and engages over the second arm. The main part of the rocker is located, in this way, outside the path of the insertion element. Only the weft thread guide element or the weft thread eye projects beyond the batten beam into the path of the shuttle.

A preferred embodiment of a weft thread control device in accordance with the invention is further characterized by the fact that the rocker is connected to the frictional braking device via a tension/compression arm which penetrates a pivotable frictional bearing so as to be displaceable therein. The movement of the rocker may be matched exactly to the weaving rhythm or to the batten movement by means of the tension/compression arm, whereby in preferred manner the friction braking device may be arranged outside the range of movement of the batten. The friction bearing for the tension/compression arm, which can be pivoted itself, keeps the tension/compression arm free of flexure loading.

A preferred embodiment of a weft thread control device in accordance with the invention is furthermore characterized in that the rocker has a first arm connected to the tension/compression arm and pivotable about a pivot axis, upon which is fixed a second arm that projects approximately perpendicular thereto and is displaceable longitudinally therealong, which second arm supports the thread guide element. This economical and easily implemented solution is particularly robust and does not require very much space. The tension/-compression arm engages the first arm of the rocker with a favourable lever arm and optimum engagement angle.

In a further advisable refinement of a weft thread control device in accordance with the invention, a slide guide for the tension/compression arm is provided in the friction bearing and the tension/compression arm is acted upon perpendicularly with respect to its direction of displacement by means of a prestressed friction element. Thus the tension/compression arm is easily movable and is not mounted so as to be susceptible to dust. The force with which it acts on the rocker remains constant.

Furthermore it is advisable if the friction element is arranged in the region of the sliding guide and if it may be adjusted in its prestress. Thus it is possible for the force exerted on the rocker arm by the tension/compression arm to be simply and exactly matched to the respective weaving conditions (light or heavy threads, resilient or rigid threads, rapid weaving rhythms, etc.).

Small moved masses and a largely maintenance-free mechanism are finally the result if the friction bearing and possibly the tension/compression arm comprise plastics.

Embodiments of the subject of the application are described below by way of the drawings.

Figure 2:
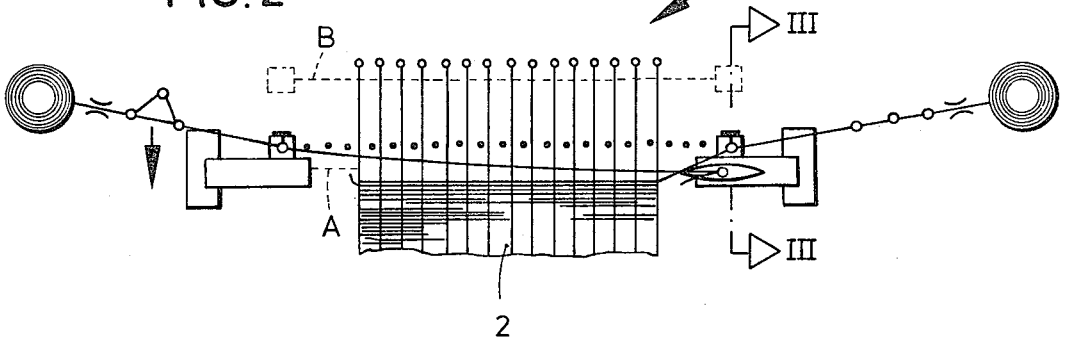
Figure 3:
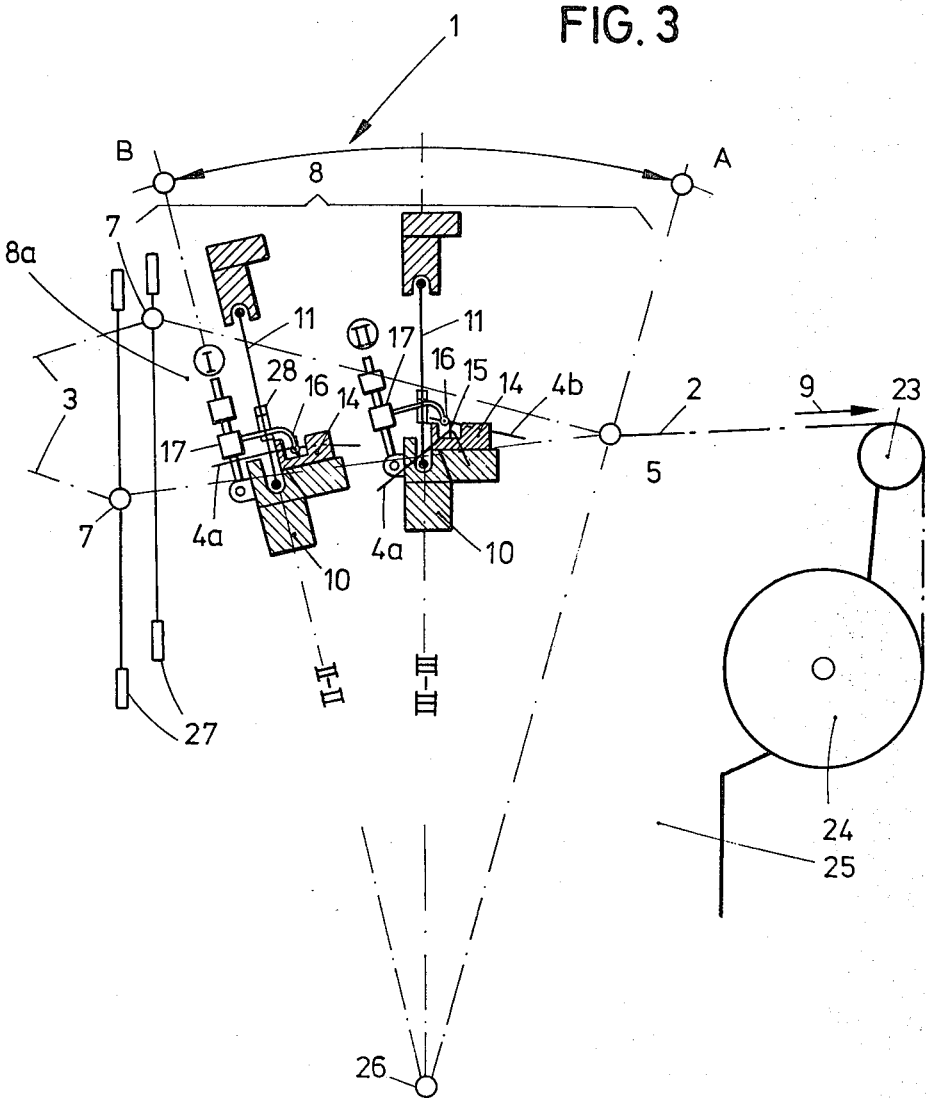
Figure 4:
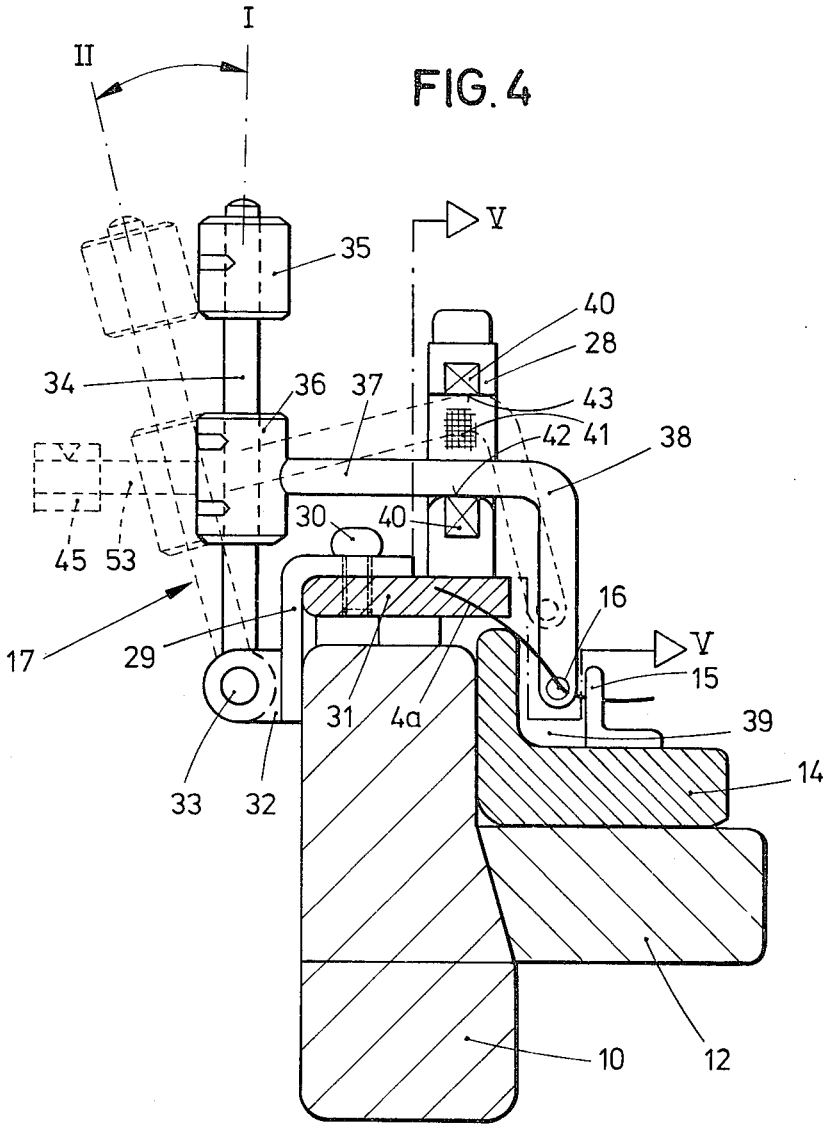
Figure 5:
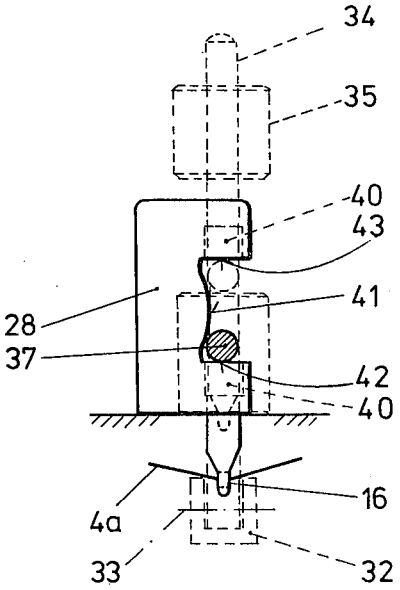
Figure 6:
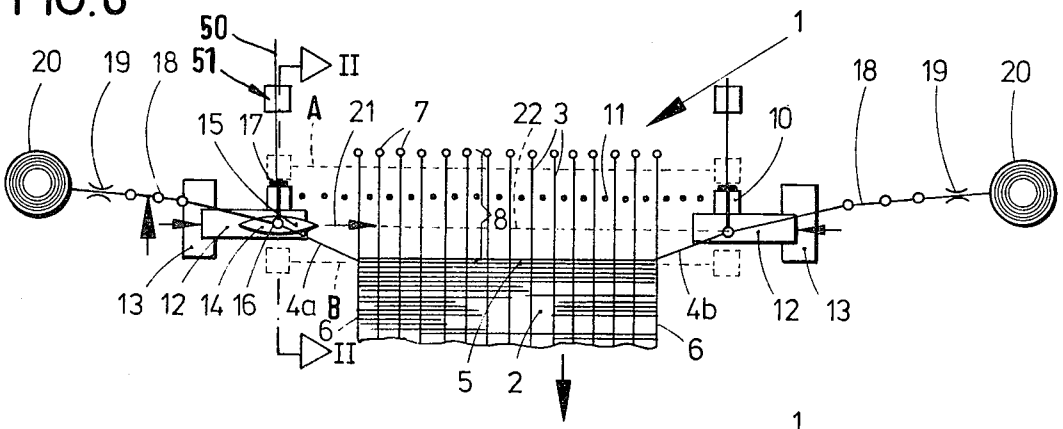
Figure 7:
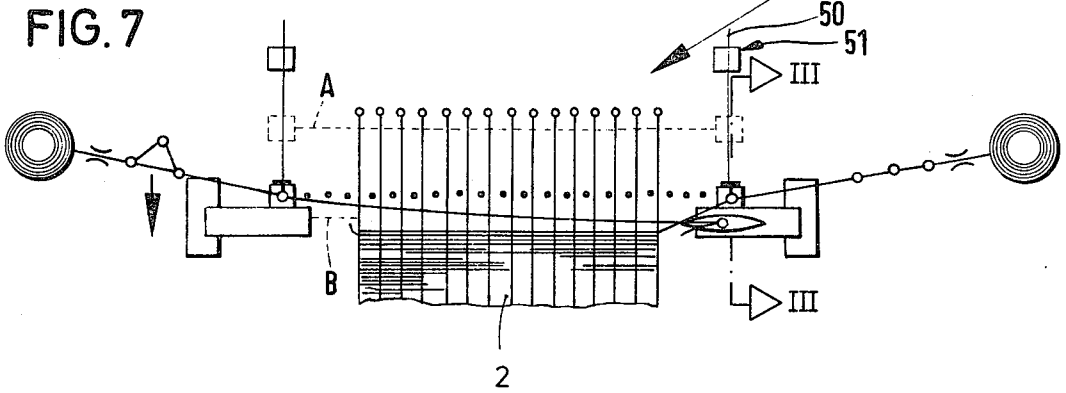
Figure 8:
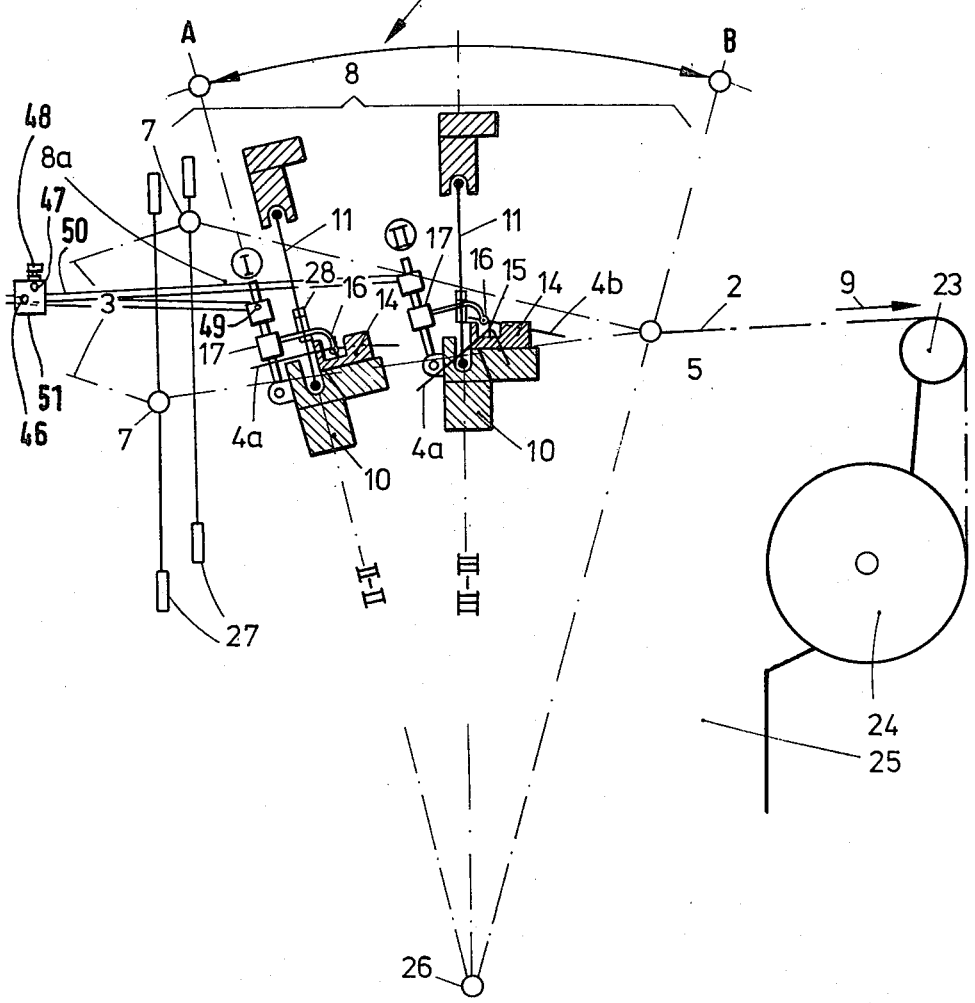
Figure 9:
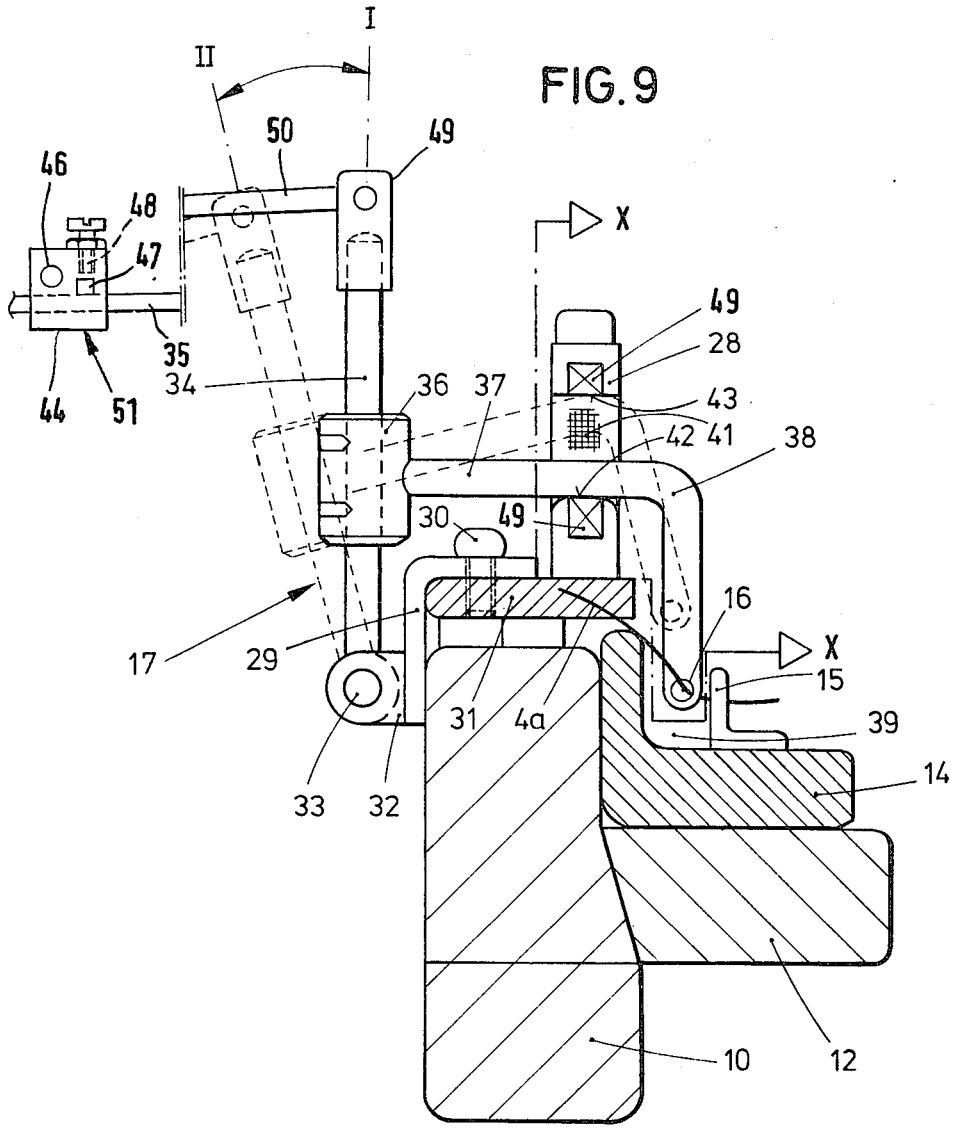
Figure 10:
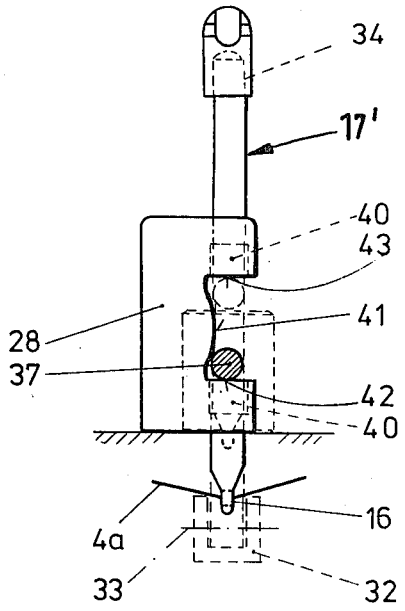
Figure 11:
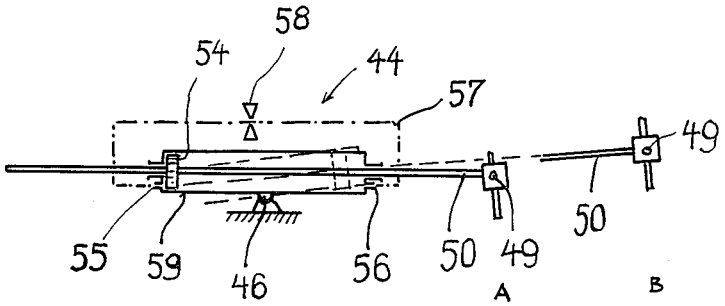
Figure 12:
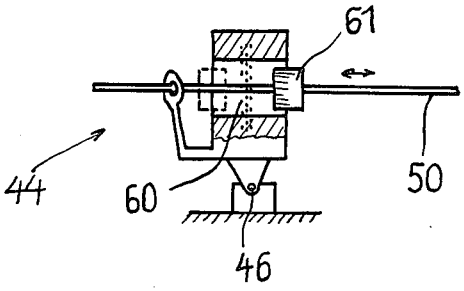

In which:

FIG. 1 shows schematically a plan view on to the area of weaving of a weaving machine in a weaving phase in which the insertion element is in the process of travelling from the left into the shed, FIG. 2 shows the schematic plan view in accordance with FIG. 1 in a weaving phase during which the insertion element is in the process of leaving the shed on the right-hand side, FIG. 3 is a composite schematic side view of the weaving machine according to FIGS. 1 and 2 in the two weaving phases previously shown, in accordance with sections II—II and III—III in FIGS. 1 and 2, FIG. 4 shows an enlarged sectional view of a detail of FIG. 3, FIG. 5 shows a sectional view along the line V—V in FIG. 4 rotated by 90°, FIGS. 6 and 7 are plan views in accordance with FIGS. 1 and 2 in a different embodiment of the control device, FIG. 8 shows a side view of a loom, in accordance with FIG. 3, of the type of embodiment of the control device according to FIG. 6 and 7, FIG. 9 shows an enlarged sectional view of a detail from FIG. 8, FIG. 10 shows a sectional view along the line X—X in FIG. 9 which sectional view is rotated by 90°, FIG. 11 shows a further embodiment of a frictional braking device, and FIG. 12 shows a still further modification of a frictional braking device.

The shed region of a loom 1 is shown in FIGS. 1 and 2, omitting loom elements which are not essential to the invention. A fabric 2 is formed in the usual manner from warp threads 3 and alternately inserted weft threads 4*a* and 4*b*. The fabric fell is designated 5 while the selvedges of the fabric are designated 6. The warp threads 3 are controlled in known manner by means of heddles 7 such that an opening shed 8 is formed. The fabric 2 is drawn off gradually in the direction of an arrow 9. A batten 10 which bears a reed 11 is arranged in the region of the shed 8. Shuttle boxes 12 are connected structurally to the batten 10, and drive devices 13 for an insertion element in the form of a shuttle 14 are associated with these shuttle boxes 12 and they shoot the said shuttle 14 through the shed. The shuttle 14 has a thread engaging element 15 which is in a position to engage the weft thread 4*a* and 4*b* that has been presented and draw it through the shed between the warp threads. The weft threads 4*a* and 4*b* are presented to the shuttle 14 by means of a thread guide element 16 in the form of a thread eye which is arranged so as to be movable on a rocker 17 shown schematically. Each weft thread runs to the thread eye 16 via a thread tensioner 18 and a thread clamp mechanism 19 from a laterally arranged supply spool 20.

In FIG. 1 there is a phase of weaving shown in which the batten 10 moves towards its rearward reversal position B after having initially beaten up the weft thread 4*b* that was last to be inserted at the cloth fell 5. The front reversal or beat up position of the batten is marked A. The shuttle 14 is on the point of being shot through the shed along its path 22 in the direction of an arrow 21. In the period of time in which the shuttle 14 passes through the shed into the opposite shuttle box 12, the reed 11 performs its rearward reversal movement and then moves forwards again towards the cloth fell 5 i.e. position A.

FIG. 2 shows schematically the phase of weaving in which the shuttle 14 leaves the shed 8. The batten 10 is still far engouth from the beat up position so that the shuttle 14 cannot be clamped by the warp threads 3.

As is clearly visible from the subsequent Figures the two thread eyes 16 on the rockers 17 are so moved synchronously by the inertial forces arising during movement of the batten that they pivot up and down between two positions I and II. In position I (FIG. 1) both thread eyes 16 keep the weft thread 4*a* or 4*b* that is being guided by them in the path of the shuttle 14 so that the shuttle is able to engage the weft thread with its thread engaging element 15 and take the weft thread with it into the shed. In position II the thread eyes are pivoted out of the path of the shuttle so that the thread engaging element thereof cannot engage the weft thread. In FIG. 1 the thread engaging element 15 of the shuttle 14 has just engaged the weft thread 4*a* which has been presented to it by the left-hand thread eye 16 and is going to insert it into the shed 8 in a U-shaped loop. Approximately at the centre of the shed the weft thread 4*a* is cut off by a cutting device not shown and on further movement of the shuttle is extended to the other side of the shed. At the right-hand fabric selvedge the free end of the weft thread which has just been inserted slides out of the thread engaging element of the shuttle before the shuttle enters the shuttle box. Up to the point in time when the weft thread 4*a* is cut off, the thread stop mechanism 19 at the left-hand fabric selvedge is open so that the shuttle is able to take the required length of weft thread from the weft thread supply 20. Approximately in synchronism with the cutting of the weft thread the thread clamping mechanism 19 is tightened so that the shuttle cannot draw off any more weft thread from the supply spool but rather is only in a position to extend the weft thread over its length through the shed. The left-hand thread extender 18 acts in known manner on the weft thread in the sense of an extending motion. Thus it should be pointed out that after the shuttle in FIG. 1 has moved into the shed 8 the batten 10 arrives in its rearward reversal position B and is then swung in the opposite direction towards the position A. The acceleration or deceleration forces thus arising cause a pivoting of both rockers into the position II (FIG. 2) in which position the shuttle 14 which is moving out of the shed (FIG. 2) is no longer able to engage the weft thread on the right-hand side of FIGS. 1 and 2, because the thread eye 16 has pivoted away. In this manner the shuttle 14 is prevented from being able to take any of the weft thread with it into the shuttle box, and thus on its return the problem of there being no further weft thread available is also prevented. The movement play described above can be seen more clearly from FIGS. 3 to 5.

In FIG. 3 the schematic overall construction of the loom can be seen in a side view. The batten 10 is shown in cross-section here and in the two phases of weaving described in FIGS. 1 and 2. The left-hand view in FIG. 3 shows the batten 10 as it moves towards the rearward reversal position B while the right-hand view shows the batten 10 as it moves towards the cloth fell 5 or the beat up position A.

The fabric 2, moved in the direction of the arrow 9, passes via a sand beam 23 to a cloth beam 24 and is wound on there. The cloth beam is mounted drivably on the base 25 of the loom. Furthermore the batten shaft is indicated by 26. The heddles 7 are controlled by shafts 27 known per se. A stop device 28 is provided in the region of the rocker 17 and it defines the two previously-mentioned positions I and II of the rocker.

The rocker 17 is fixed to the batten 10 with the aid of a cover plate 29 and a fixing element 30, the said batten at the same time supporting the shuttle path and the shuttle boxes 12. With the cover plate 29 an intermediate plate 31 is also mounted and supports the stop device 28. On the side of the batten 10 which is remote from the cloth fell 5 there is a bearing 32 for a pivot axis 33, provided on the cover plate. A first arm 34 of the rocker 17, which arm is approximately vertical, extends upwardly from the said bearing. At its upper end the arm 34 supports a ballast weight 35 which can be adjusted with respect to its spacing from the pivot axis 33 or varied in its mass in a manner not shown in greater detail. At approximately half the height of the arm 34 a sliding sleeve 36 is adjustably arranged thereon, and a second arm 37 which is approximately horizontal extends towards the cloth fell from this sliding sleeve 36 and has a curve in the region 38 and a thread eye 16 at its downwardly projecting free end. In the position I shown in solid lines the arm 37 with the thread eye 16 plunges into a longitudinal groove 39 of the shuttle 14 and presents the weft thread 4*a* to the thread engaging element 15 of the shuttle 14 for the purpose of being engaged. The weft thread 4*a* passes from top left from the thread tensioner not shown through thread eye 16, and then in an approximately horizontal direction towards the cloth fell 5. Thus it crosses the imagined path of movement of the thread engaging element 15.

The stop device 28 (FIG. 5) is C-shaped as seen by the weaver and has a lower and an upper stop surface 42,43 for the horizontal portion of the arm 37. These surfaces are connected together by means of an arresting curve 41, the arm 37 having to slide along this curve when pivoting the rocker between its two positions I and II as defined by the stop surfaces 42 and 43. The arresting curve by its action ensures tht the arm 37 remains force locked in either one or the other position I or II and ensures that no intermediate positions may be taken up. Basically or as an alternative to the locking curve 41 permanent magnets 40 may be arranged in the stop surfaces 42 and 43, these permanent magnets exercising a retaining force on the arm 37, which comprises metal, so that it is also categorically forced to remain in one or the other position.

As indicated in broken lines in FIG. 4 the arm 37 may of course be extended rearwardly beyond the sliding sleeve 36 (extension 53) and may bear a further ballast weight 45 there. Furthermore in broken in lines it is shown in FIG. 4 how the rocker 17 is tilted backwards in position II to lift the thread eye 16 out of the longitudinal groove 39 of the shuttle 14 so that its thread engaging element 15 can no longer engage the weft thread 4*a*.

The mode of operation of the rocker 17 will be shown below and described particularly by way of FIGS. 3 and 4:

Owing to the inertia of the ballast weight 35 and any additional ballast weight 45, the rocker 17 pivots into the position I as soon as the batten has reached the position A and has beat up the weft thread last inserted. The pivoting of the rocker takes place therefore against the retention forces of the locking curve 41 or the magnets 40, and in fact either by means of the deceleration of the batten during beat up or by means of acceleration of the same following the reversal movement of the batten as it begins to move again to position B. Thus it is important that both rockers, each arranged at one end of the batten 10, move into this position I. During subsequent movement of the batten 10 into the left-hand position in FIG. 3, the rockers 15 remain in position I, being supported by the magnets 40 and/or the locking curve 41. When the batten 10 reaches approximately the position on the left-hand side of FIG. 3 then (FIG. 1) the shuttle 14 begins its inward movement into the shed 8 from the left-hand side. It then passes the thread eye 16 and with its thread engaging element 15 engages the weft thread 4*a* presented to it. While the shuttle 14 moves through the shed 8 the batten 10 arrives in its rearward reversal position B and starts to move to the position A again. On reversal movement at position B or on acceleration of the batten 10 which follows this, the inertial forces in the ballast weight 35 and possibly 45 cause the rocker 17 to tilt against the retention force of the locking curve 41 or of the magnet 40. The rocker tilts into the position II and thus raises the thread eye 16 out of the path of the thread engaging element 15 of the shuttle 14. During the reversal movement of the batten 10 at point B and the pivoting movement of the rocker 17, the shuttle 14 has moved further through the shed 8. When the batten 10 has arrived approximately at the right-hand position in FIG. 3 then the shuttle 14 passes out of the shed 8 on the right-hand side of FIG. 1. Since however the two rockers 17 are already pivoted into the position II, the thread engaging element 15 may pass through unhindered underneath the raised thread eye 16 so that the shuttle 14 arrives in the shuttle box 12. The shed is then free, the weft thread 4*a* is inserted and the batten 10 can beat up this weft thread to the cloth fell 5. Then the shed is changed by means of the heddles 7 As the batten 10 beats up in position A or on subsequent acceleration of the batten, both rockers 17 tilt in turn into the position I so that the weft thread is again presented for engagement to the shuttle 14 coming from the right in FIG. 1, this time of course by the right-hand rocker in FIG. 1 and by thread eye 16. Then the prescribed movement play is provided in the reverse direction whereby here too the movement of the weft thread takes place exclusively due to the inertial forces which are transmitted by the batten to the rockers. Thus it is not significant that each rocker respectively carries out a blind movement or an idling stroke that is not necessary for shuttle movement.

The outstanding advantage of this weft thread control device lies in the omission of any drive connections between the drive of the loom and the rockers, or any independent control device for the weft thread movements which is electrically or electromagnetically tuned to the weaving rhythm. Thus there is realize the production of force components by the intersecting movements between the batten, the weft threads and the insertion element that are highly suitable for carrying out weft thread control.

Rockers constructed as one-piece die-cast members could also be used. The stop device could also be arranged at a different point and have a different form, in order to define two positions of the rocker. The rockers could be arranged directly at the shuttle box in order to take account of the space conditions which are restricted in the region of weaving. Obviously the rockers may also be arranged subsequently on a loom which has already been in operation. They are also suitable for reliably carrying out their function in a loom with other spool-less weft thread insertion elements.

In FIGS. 6 and 7 the weaving region of a loom is shown in accordance with FIGS. 1 and 2 in which rockers 17 are provided which are not adjusted by the inertial forces during movement reversal of the batter 10 but rather are coupled via tension/compression arms 50 with friction brake devices 51 which are structurally connected to the frame of the loom. The change in control of the rockers takes place in each case after the reversal point of the batten 10 in the movement phase in which the batten experiences renewed acceleration.

FIG. 8 corresonds essentially to FIG. 3 except of course that the movement control of the rockers 17' takes place with the aid of the tension/compression arms 50. The rockers 17' may cooperate in fact with a stop device 28 by means of which the two positions I and II are maintained in addition to the effect of the friction brake device. This type of stop device 28 however is not absolutely necessary for the functioning of the rockers 17' since the friction brake device 51 automatically ensures sufficient retention force, due to the "break loose force" from stationary to sliding friction at the tension/compression arm 50. The other elements in the region of weaving correspond to those which have been described already in FIGS. 1 to 5 so that this is not dealt with in greater detail.

In broken lines in FIG. 9 it is shown how the rocker 17' in the position II tilts backwards and the thread eye 16 has moved out of the longitudinal groove 39 of the shuttle 14 so that its thread engaging element 15 no longer engages the weft thread 4*a*. The tension/compression arm 50 penetrates a friction bearing 44 in the friction brake device 51, which can be pivoted about a bearing pin 46. A friction element 47 presses on the arm 50 inside the bearing since this said friction element 47 can be set by means of an adjusting screw 48. Thus the frictional force for the arm 50 can be set.

The stop device 28 (FIG. 10) is constructed substantially the same as in FIGS. 4 and 5; the rocker 17' is distinguished from the previously described rocker only by the fact that it does not have a ballast weight.

The mode of operation of the rocker 17' is described below particularly by way of FIGS. 8 and 9: The tension/compression arm 50 tilts the rocker 17' into position I by means of the firction at the tension/compression arm 50 as soon as the batten 10 leaves the position A. Pivoting the rocker takes place suddenly against the retention forces of the locking curve 41 or the magnets 40 when the batten 10 begins to move towards the position B. Thus it is important that both rockers, each arranged respectively at an end of the batten 10, move into this position I. During the subsequent movement of the batten 10 into the left-hand position in FIG. 8, the rockers 17' remain in the position I, supported by the pressure of the arms 50 and by the magnets 40 and/or the locking curve 41. Shortly before the batten 10 reaches the position B which is on the left-hand side in FIG. 8, the shuttle 14 (FIG. 6) begins its inward movement into the shed 8 from the left-hand side. It then passes the thread eye 16 with its thread engaging element 15 and engage the weft thread 4*a* presented to it. While the shuttle 14 moves through the shed 8, the batten 10 begins to move out of reversal position B again towards position A. With acceleration of the batten 10 out of the position B the tension/compression arms 50 cause tilting of the rockers 17' against the retention force of the locking curve 41 or the magnet 40. The rockers both tilt into the position II and thus raise the thread eyes 16 out of the path of the thread engaging element 15 of the shuttle 14. When the batten 10 reaches approximately the right-hand position in FIG. 8 then the shuttle 14 passes out of the shed on the right-hand side in FIG. 6. However, since the two rockers 17' are already pivoted into the position II, the thread engaging element 15 may pass unhindered under the raised thread eye 16. The shed is then free, the weft thread 4*a* is inserted and the batten 10 is able to beat up this weft thread to the cloth fell 5. Then the change in shed takes place by means of the heddles 7. On acceleration of the batten 10 out of the position A both rockers 17' tilt again into the position I so that the weft thread is presented again for engagement by the shuttle 14 coming from the right in FIG. 6, this time of course by the right-hand rocker and thread eye 16 in FIG. 1. Then the prescribed movement play takes place in the reverse direction. Thus it is not significant that each rocker carries out a blind movement or an idling stroke that is not necessary for movement of the shuttle. FIG. 11 shows an alternative embodiment of the control device wherein the frictional braking device 44 is formed by a cylinder 59 containing a slidably guided double-acting piston 54. Cylinder 59 is connected to the stationary portion of the loom by being mounted on pivot bearing 46. The stroke of piston 54 within cylinder 59 corresponds at least to the distance that the batten moves between its positions A and B. The tension/compression arm 50 is connected to piston 54 and extended therebeyond so as to guide the piston over its full stroke in the manner of a piston rod. The cylinder-piston unit 59, 54 may be a simple pneumatic cylinder. Piston 54 divides the interior space of cylinder 59 into separate chambers each provided with an outlet and/or inlet 55 and 56, respectively, through which the air compressed by the piston may escape and the intake air may enter, respectively. The outlets and/or inlets 55 and 56 may be designed so as to restrict the passage of air therethrough, so that the movement of piston 54 after each reversal is counteracted by the flow resistance, or frictional resistance, respectively, of the air. The outlet/inlets 55 and 56 may be suitably interconnected or short-circuited by a flow conduit 57 including an adjustable restriction 58. In this manner there is provided a closed compressed-air system in which the air compressed by piston 54 is subjected to a throttling effect, whereby the tension/compression arm is always subjected to a force opposing the movement of the batten and effective to control the movements of the rocker between its positions I and II.

In the embodiment of FIG. 12, the frictional braking device 44 comprises a magnetic field 60 and a metallic core 61 connected to the tension/compression arm 50 for movement through said field 60 during movements of the batten. In this manner the forces for actuating the rockers 17′ are produced without any influence of mechanical friction. The magnetic field 60 may be generated in a conventional manner either by electromagnets or by permanent magnets.

We claim:

1. A weft thread control device for a loom having a supply spool from which weft thread is drawn, an insertion element having a thread engaging element and which is movable along a defined path to carry thread drawn off of the supply spool through the shed of warp threads, a batten movable substantially transversely to said path between a pair of reversal positions at each of which the batten reverses its direction of motion and at one of which it engages the last-placed weft thread to beat up the same, and a movable thread guide element by which thead drawn off of the supply spool is presented to said thread engaging element as the insertion element enters the shed and is held clear of the thread engaging element as the insertion element moves out of the shed, said weft thread control device being characterized by:

A. a member by which said thread guide element is carried;

B. means mounting said member on the batten for bodily movement therewith and for limited movement relative thereto between (1) a first position of said member wherein the thread guide element is so located that thread drawn off of the supply spool extends across said path and (2) a second position of said member wherein the thread guide element is located to dispose said thread clear of said path; and C. means connected with said member for yieldingly resisting its movement with the batten during reversal of the direction of motion of the batten, so that said member is moved from one to the other of its said positions in consequence of each movement of the batten through a reversal position.

2. The weft thread control device of claim 1 wherein said means connected with said member for yieldingly resisting its movement with the batten comprises mass means whereby said member is moved from one to the other of its said positions by inertia forces incident to acceleration and deceleration of the batten as it moves through a reversal position.

3. The weft thread control device of claim 1 wherein said means connected with said member for yieldingly resisting its movement with the batten comprises friction means further connected with a relatively stationary part of the loom, whereby said member is moved from one to the other of its said positions during initial movement of the batten away from each reversal position.

4. The weft thread control device of claim 3 wherein said friction means comprises pneumatic cylinder and piston means having restricted ports through which air passes with throttled flow.

5. The weft thread control device of claim 1 wherein said loom has a supply spool near each of a pair of opposite ends of the batten, and wherein said member is located near one of said ends of the batten, there being a second similar member near the other end of the batten having similar means associated therewith.

6. The weft thread control device of claim 1 wherein said means mounting said member on the batten comprises a pivot constrained to move with the batten and about which said member is rockable.

7. The weft thread control device of claim 6 wherein said member comprises:

(1) an arm projecting substantially transversely to the axis of said pivot and to the motions of said batten and (2) a weight on said arm, spaced from said axis, to provide inertia forces whereby said member is moved from one to the other of its said positions in consequence of acceleration and deceleration of the batten as it moves through each reversal position.

8. The weft thread control device of claim 7 wherein said weight is arranged for adjustment along said arm to different distances from said axis.

9. The weft thread control device of claim 1, further characterized by:

D. arresting means connected between said member and the batten whereby motion of said member between its said first and second positions is yieldingly resisted as said member moves through a zone intermediate said positions.

10. The weft thread control device of claim 9 wherein said arresting means comprises means defining a convexly curved friction surface slidingly engaging by said member as it moves between its said positions.

11. The weft thread control device of claim 9 wherein said arresting means comprises cooperating magnetic means (1) on the batten, constrained to move in unison therewith, and (2) on said member, constrained to move in unison therewith relative to the batten.

* * * * *